US008371576B2

(12) United States Patent
Cundick et al.

(10) Patent No.: US 8,371,576 B2
(45) Date of Patent: Feb. 12, 2013

(54) MEDIA SHEET STACKING IMPLEMENT

(75) Inventors: Darron Palmer Cundick, Lexington, KY (US); Daniel Lee Thomas, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 81 days.

(21) Appl. No.: 12/978,735

(22) Filed: Dec. 27, 2010

(65) Prior Publication Data

US 2012/0161390 A1 Jun. 28, 2012

(51) Int. Cl.
*B65H 43/00* (2006.01)

(52) U.S. Cl. ..... 271/176; 271/207; 270/58.11

(58) Field of Classification Search ..... 271/273, 271/176, 278, 207, 220; 270/58.11, 58.08, 270/58.12

See application file for complete search history.

(56) References Cited

U.S. PATENT DOCUMENTS

| | | | | |
|---|---|---|---|---|
| 6,997,456 | B2 * | 2/2006 | Fukatsu et al. | 271/306 |
| 7,192,020 | B2 * | 3/2007 | Hayashi et al. | 270/58.11 |
| 7,255,340 | B2 * | 8/2007 | Anezaki et al. | 271/176 |
| 7,258,339 | B2 * | 8/2007 | Fukatsu et al. | 271/220 |
| 7,810,805 | B2 * | 10/2010 | Suzuki | 271/207 |
| 2010/0150636 | A1 * | 6/2010 | Kubota et al. | 399/407 |

* cited by examiner

*Primary Examiner* — Kaitlin Joerger
(74) *Attorney, Agent, or Firm* — John Victor Pezdek

(57) ABSTRACT

A media sheet stacking implement for an image forming apparatus according to one example embodiment includes an exit nip formed by a first exit roller and a second exit roller for advancing media in a media process direction along a media path and delivering the media to an output bin of the image forming apparatus. A pinching element is mounted along the media path downstream from the exit nip. The pinching element has at least one first member and at least one second member movable relative to the at least one first member between a closed state and an open state. An actuating mechanism is operatively coupled with the pinching element for moving the pinching element between the closed state and the open state to allow the pinching element to hold a trailing end of a media sheet to be delivered to the output bin when in the closed state.

22 Claims, 11 Drawing Sheets

MEDIA SHEET STACKING IMPLEMENT

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to the stacking of media sheets in an output bin of an image forming apparatus, and more specifically, to a media sheet stacking implement that improves the stacking quality of media sheets collected in the output bin.

2. Description of the Related Art

Recent developments in the field of image forming apparatuses, such as printers or copiers, have substantially increased the output speeds of such devices. When a large number of media sheets are printed at increased output speeds, in some instances, the stacking quality of the media sheets in an output bin of the apparatus may degrade. Specifically, the speed of the media sheets leaving a pair of exit rollers and entering the output bin may be so high that poor stacking quality and loss of collation result. In extreme cases, the output bin may not be able to retain the media causing it to fall from the apparatus. FIG. 1 illustrates an example of poor stacking quality of media sheets 10 in an output bin 12 of an image forming apparatus 14. In contrast, FIG. 2 shows the desired stacking in output bin 12.

One known solution for addressing the reduction in stacking quality that may occur at increased output speeds is the use of a metal bail that secures the media sheets in the bin. However, it has been observed that many users do not employ such bails for various reasons. Accordingly, it will be appreciated that a device that increases the stacking quality of media sheets in the output bin of an image forming apparatus is desired.

SUMMARY OF THE DISCLOSURE

A media sheet stacking implement for an image forming apparatus according to one example embodiment includes an exit nip formed by a first exit roller and a second exit roller for advancing media in a media process direction along a media path and delivering the media to an output bin of the image forming apparatus. A pinching element is mounted along the media path downstream from the exit nip. The pinching element has at least one first member and at least one second member movable relative to the at least one first member between a closed state and an open state. In some embodiments, the position of the at least one first member of the pinching element is fixed.

An actuating mechanism is operatively coupled with the pinching element for moving the pinching element between the closed state and the open state to allow the pinching element to hold a trailing end of a media sheet to be delivered to the output bin when in the closed state. Embodiments include those wherein the actuating mechanism includes an actuating member pivotally mounted along the media path and operatively coupled with the at least one second member of the pinching element. In some embodiments, the actuating member includes a central shaft pivotally mounted on the image forming apparatus and at least one first arm extending from the central shaft at a first angle. A biasing member biases the at least one first arm toward a home position obstructing the media path upstream from the exit nip. Further embodiments include those wherein the actuating member includes at least one second arm extending from the central shaft at a second angle different from the first angle and engaged with the at least one second member of the pinching element. In some embodiments, a first lever is mounted on the central shaft of the actuating member and rotates therewith. A torque limiting gear is positioned on a shaft of one of the first exit roller and the second exit roller that rotates therewith and a second lever is mounted on the torque limiting gear and rotates therewith. In such embodiments, rotation of the exit nip in a direction opposite the media process direction causes the second lever to contact and actuate the first lever thereby rotating the central shaft of the actuating member and causing the at least one second member to move away from the at least one first member to move the pinching element from the closed state to the open state.

A method for controlling the speed of a media sheet exiting an image forming apparatus according to one example embodiment includes advancing the media sheet along a media path in a media process direction through an exit nip formed by a pair of exit rollers. The media sheet is advanced between a pair of opposed members of a pinching element in an open state downstream from the exit nip. The pinching element moves from the open state to a closed state to hold a trailing end of the media sheet and reduce the speed of the media sheet. In some embodiments, the pinching element moves from the open state to the closed state when a trailing edge of the media sheet passes an actuating member positioned along the media path upstream from the exit nip. The pinching element then moves from the closed state to the open state to release the trailing end of the media sheet to allow the media sheet to be collected in an output bin of the image forming apparatus. Where a subsequent media sheet is present, the pinching element moves from the closed state to the open state when a leading edge of the subsequent media sheet contacts the actuating member. Alternatively, the pinching element is moved from the closed state to the open state by rotating the exit rollers opposite the media process direction.

BRIEF DESCRIPTION OF THE DRAWINGS

The above-mentioned and other features and advantages of this disclosure, and the manner of attaining them, will become more apparent and the disclosure will be better understood by referencing the following description of embodiments of the disclosure taken in conjunction with the accompanying drawings, wherein.

DETAILED DESCRIPTION

It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item. Unless limited otherwise, the terms "coupled," and variations thereof herein are used broadly and encompass direct and indirect couplings. Furthermore, the use of "coupled" and variations thereof herein does not denote a limitation to the arrangement of two components.

The present disclosure provides a media sheet stacking implement for an image forming apparatus, such as a printer or a copier. The media sheet stacking implement improves the stacking quality of media sheets collected in an output bin of the image forming apparatus. Specifically, the media sheet stacking implement reduces the speed of the media sheets, and in some embodiments stops the media sheet, leaving a pair of exit rollers of the image forming apparatus thereby allowing the media sheets to be collected in the output bin in a substantially uniform manner.

Figure 1:
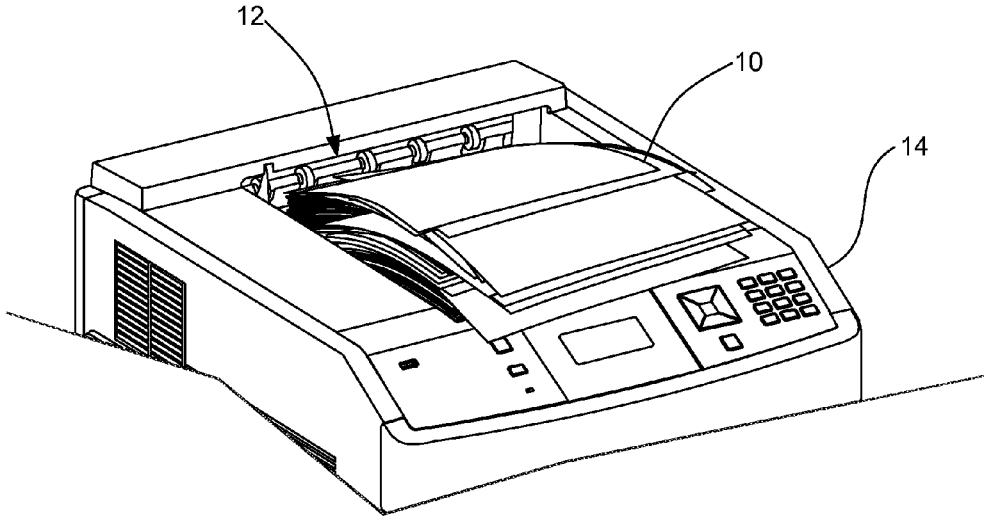
FIG. 1 is a perspective view depicting poor media stacking quality in an output bin of an image forming apparatus.
Figure 2:
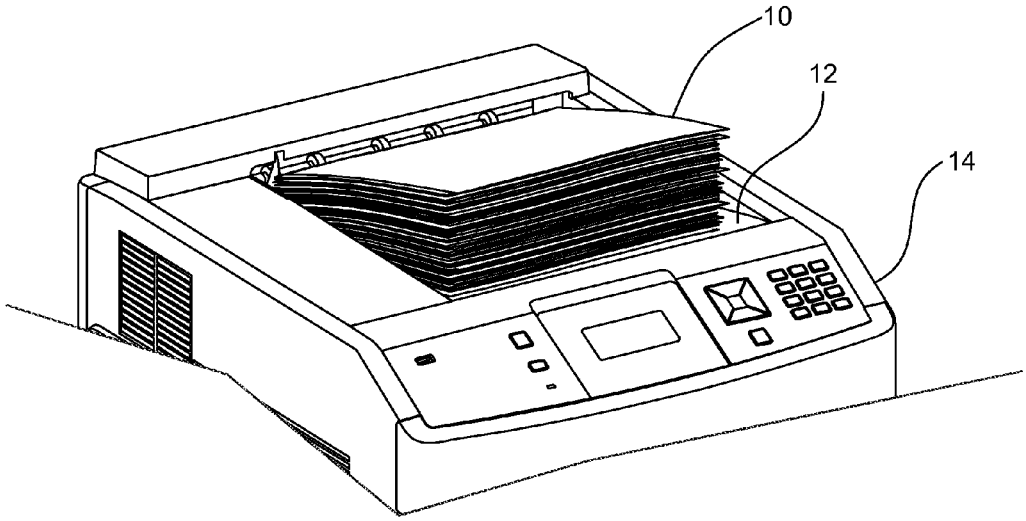
FIG. 2 is a perspective view depicting desired media stacking quality in the output bin.
Figure 3:
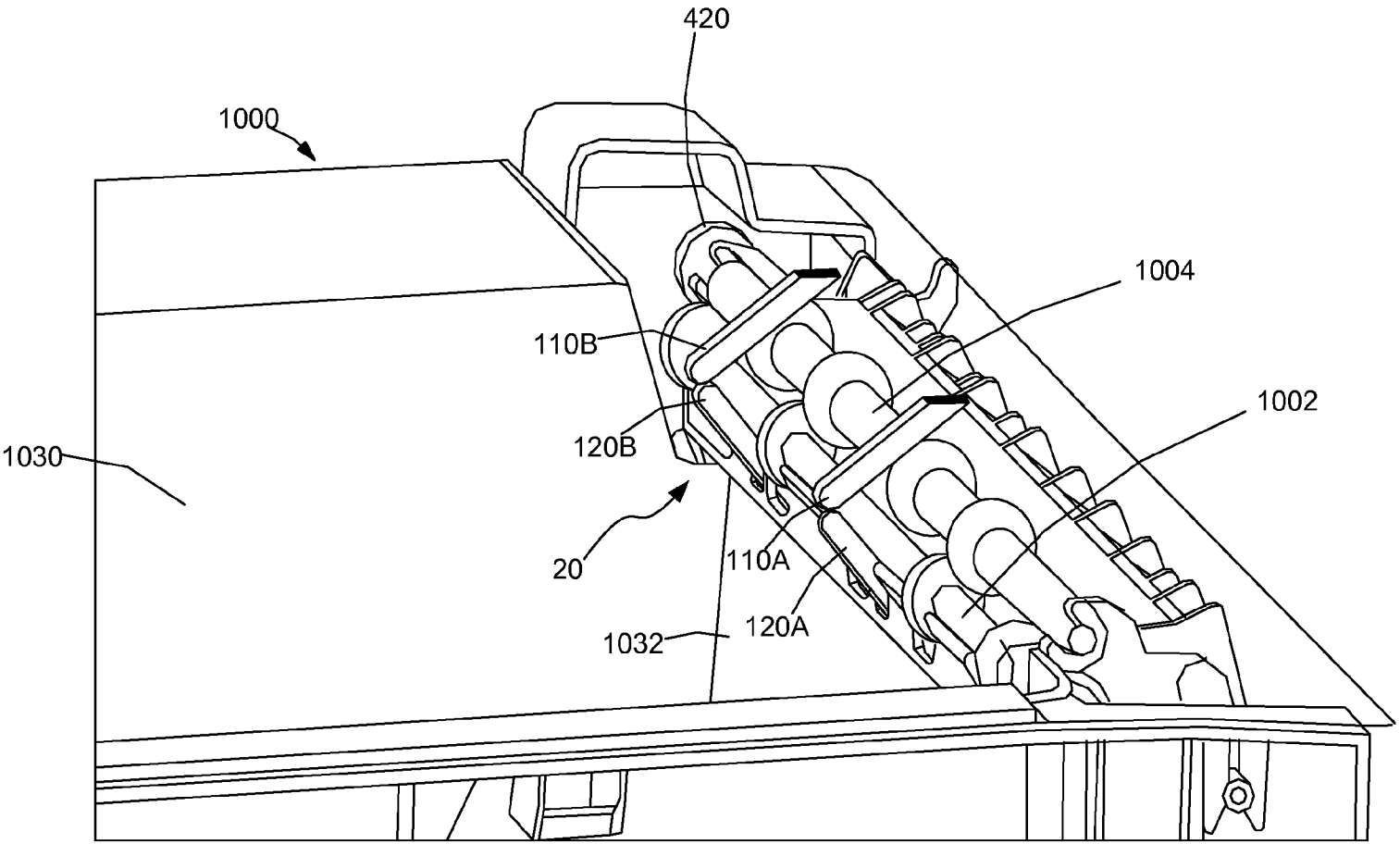
FIG. 3 is a perspective view depicting the media sheet stacking implement positioned on an image forming apparatus with a top cap cover of the image forming apparatus removed for clarity according to one example embodiment.
Figure 4:
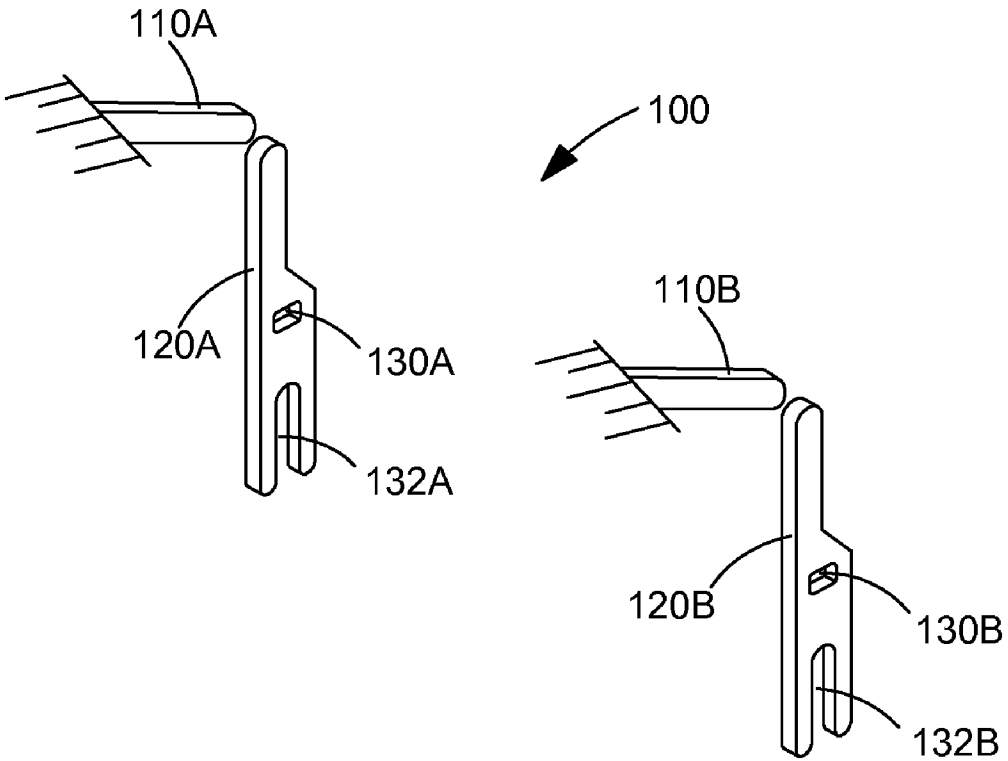
FIG. 4 is a perspective view depicting a pinching element of the media sheet stacking implement according to one example embodiment.

Referring to FIGS. 3 and 4, a media sheet stacking implement 20 includes a pinching element 100. Pinching element 100 includes at least one fixed member 110 and at least one moveable member 120. In the example embodiment illustrated, pinching element 100 includes a pair of fixed members 110A and 110B, and a pair of movable members 120A and 120B. It will be appreciated that the number of fixed members 110 and movable members 120 of pinching element 100 may be any suitable number. Embodiments include those wherein each fixed member 110A, 110B and each movable member 120A, 120B is an elongated flat piece having a substantially rounded tip. Each movable member 120A, 120B includes an opening 130 and a channel 132. For example, movable member 120A includes an opening 130A at a central portion and a channel 132A at an end portion of movable member 120A. Similarly, movable member 120B includes an opening 130B and a channel 132B. Openings 130A, 130B and channels 132A, 132B permit the mounting of movable members 120A, 120B on an image forming apparatus 1000, which will be explained in greater detail in conjunction with FIG. 7. Pinching element 100 is mounted along a media sheet path 500 (FIGS. 7-10) downstream from a pair of exit rollers 1002 and 1004 of image forming apparatus 1000. Exit rollers 1002, 1004 advance media in a media process direction indicated by arrow A in FIGS. 7-10.

Figure 7:
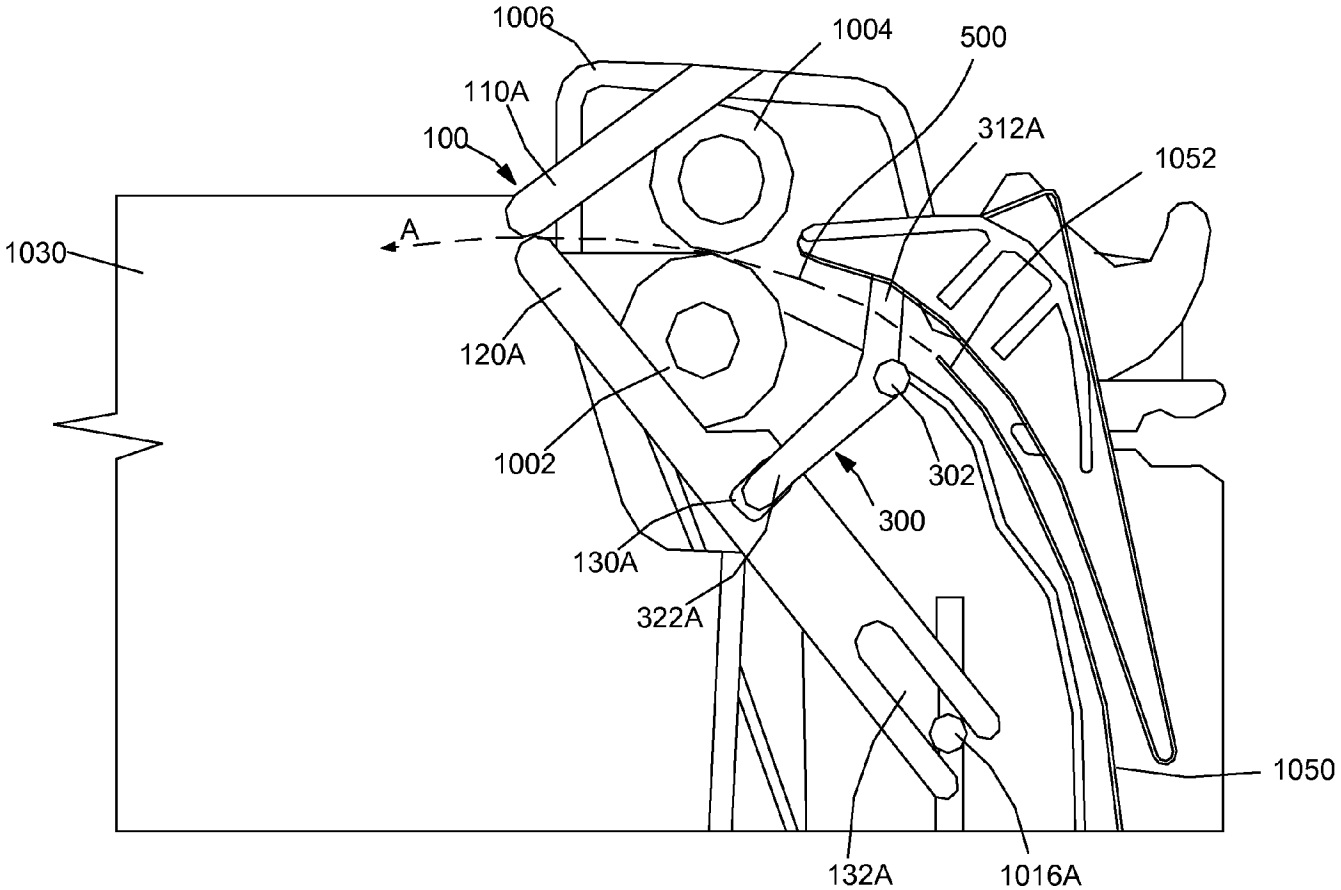
FIGS. 7-10 are side views depicting operational states of the media sheet stacking implement in conjunction with a media sheet and a subsequent media sheet according to one example embodiment.
Figure 8:
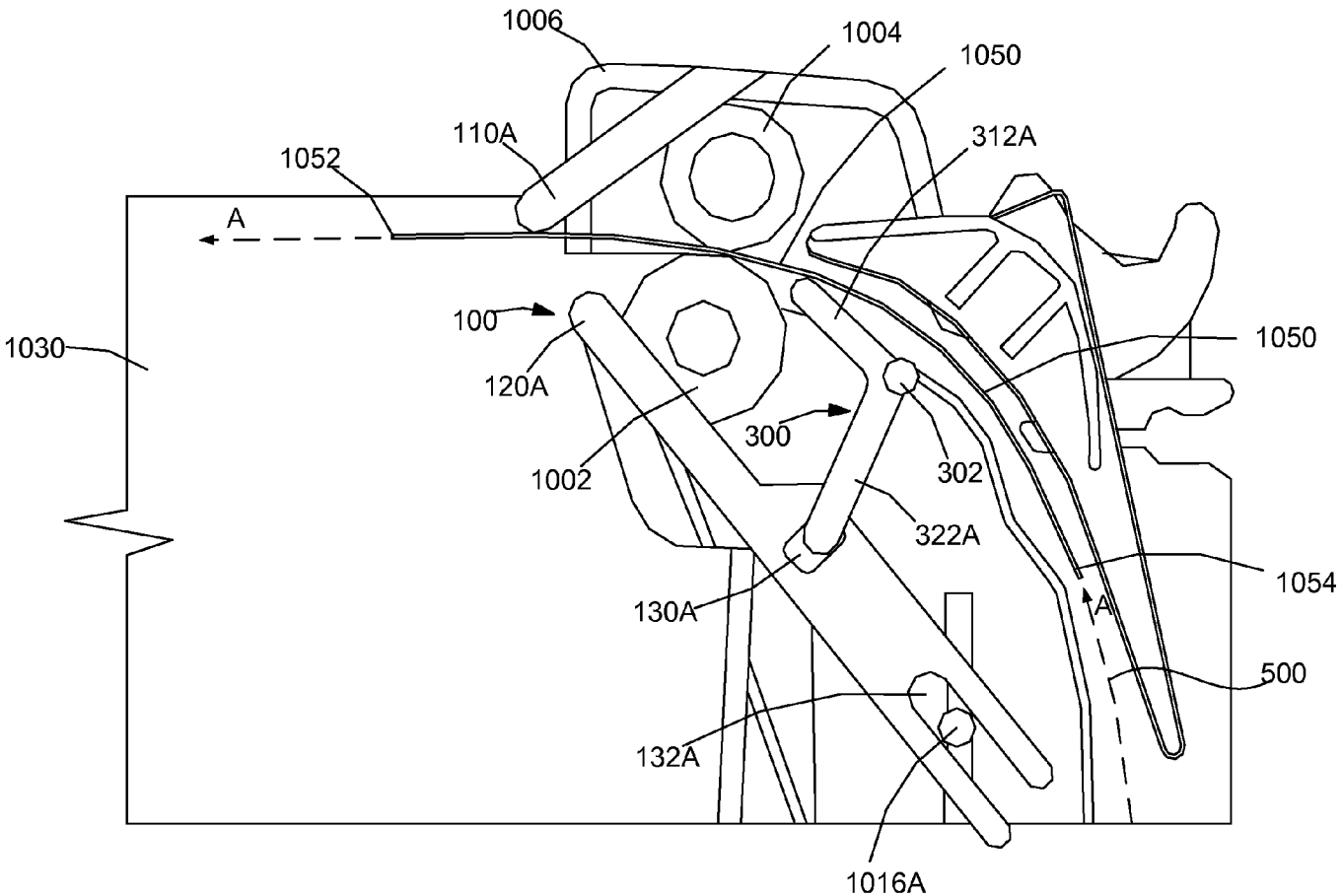

In the example embodiment illustrated, fixed members 110A, 110B of pinching element 100 are coupled to a top cover cap 1006 of image forming apparatus 1000 (FIGS. 7-10). Alternatively, fixed members 110A, 110B may be mounted at any suitable portion of image forming apparatus 1000 downstream from exit rollers 1002, 1004. Movable members 120A, 120B of pinching element 100 are also mounted on suitable portions of image forming apparatus 1000 downstream from exit rollers 1002, 1004, which will be explained in greater detail in conjunction with FIG. 7. Movable members 120A, 120B are movable toward and away from fixed members 110A, 110B enabling an open and closed state of pinching element 100. When pinching element 100 is in a closed state, movable members 120A, 120B contact fixed members 110A, 110B, respectively. For example, as shown in FIG. 7, movable member 120A is contacting fixed member 110A in the closed state of pinching element 100. To reach the open state, moveable members 120A, 120B move away from fixed members 110A, 110B. For example, as shown in FIG. 8, movable member 120A is moved away from fixed member 110A in the open state of pinching element 100. In the example embodiment illustrated, pinching element 100 is formed by at least one fixed member 110 and at least one movable member 120; however, alternatives include those wherein pinching element 100 is formed by opposed movable members.

Figure 5:
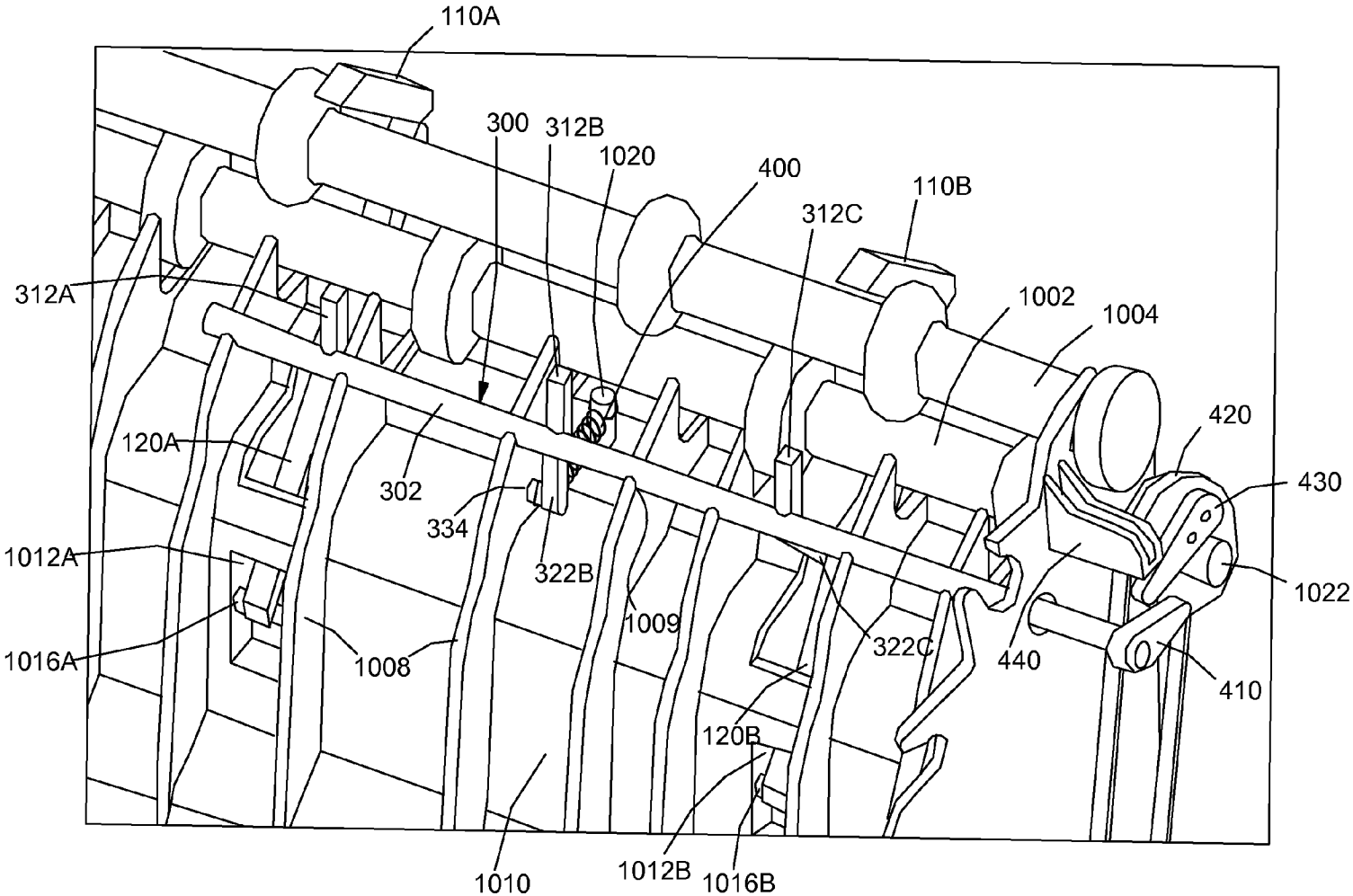
FIG. 5 is a perspective view depicting the media sheet stacking implement positioned on an image forming apparatus according to one example embodiment.
Figure 6:
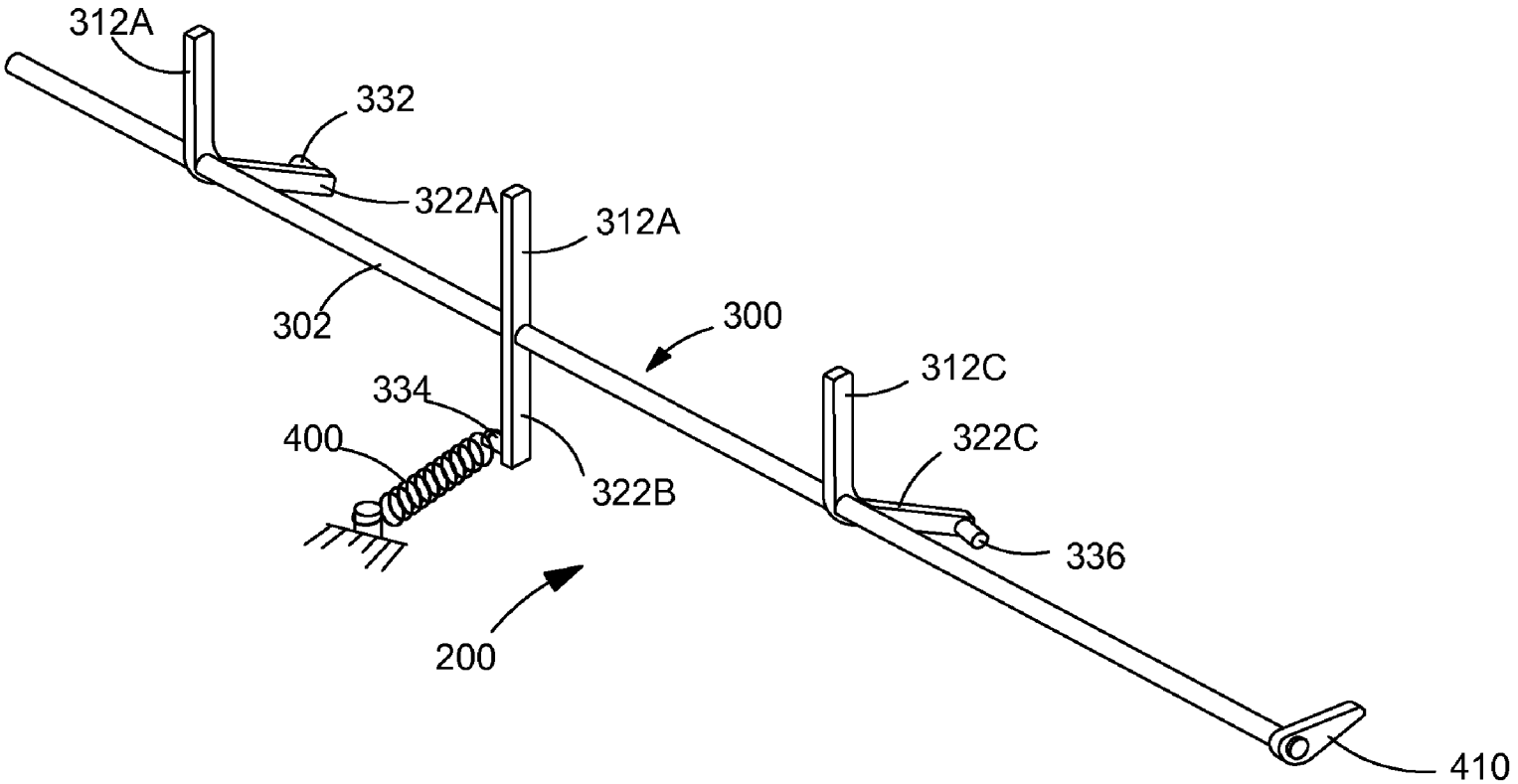
FIG. 6 is a perspective view depicting an actuating mechanism of the media sheet stacking implement according to one example embodiment.

With reference to FIGS. 5 and 6, stacking implement 20 further includes an actuating mechanism 200 operatively coupled with pinching element 100. Specifically, actuating mechanism 200 actuates pinching element 100 allowing pinching element 100 to attain one of the open state and the closed state. In the example embodiment illustrated, actuating mechanism 200 includes an actuating member 300. Actuating member 300 is pivotally mounted on media sheet path 500 upstream from exit rollers 1002, 1004. Actuating member 300 obstructs media sheet path 500 as shown in FIG. 7. Actuating member 300 is operatively coupled with movable members 120A, 120B of pinching element 100, which is further explained herein in greater detail.

Actuating member 300 includes a central shaft 302 pivotally mounted on a portion of image forming apparatus 1000. For example, central shaft 302 is pivotally carried by supporting plates 1008, as shown in FIG. 5, underneath media sheet path 500. Supporting plates 1008 include substantially circular cutouts 1009 that receive central shaft 302 thereby allowing actuating member 300 to pivotally move about supporting plates 1008.

With continued reference to FIGS. 5 and 6, actuating member 300 also includes at least one first arm 312 extending from central shaft 302. In the present embodiment, actuating member 300 includes first arms 312A, 312B, and 312C extending from central shaft 302. First arms 312A, 312B, 312C of actuating member 300 obstruct media sheet path 500. Specifically, as shown in FIG. 7, the at least one first arm 312 is positioned at the middle of media sheet path 500.

Actuating member 300 further includes at least one second arm 322 extending from the central shaft 302. In the example embodiment illustrated, actuating member 300 includes second arms 322A, 322B, and 322C extending from a common portion of central shaft 302 with respect to first arms 312A, 312B, and 312C. Further, second arms 322A, 322B, 322C are angularly oriented with respect to first arms 312A, 312B, 312C, respectively. For example, second arms 322A, 322C form a generally L-shaped structure with respect to first arms 312A, 312C whereas second arm 322B forms a generally I-shaped structure with respect to first arm 312B. However, it will be appreciated that first arms 312A, 312B, 312C and second arms 322A, 322B, 322C may not extend from common portions of central shaft 302 and may form configurations other than L-shaped or I-shaped structures.

As mentioned above, actuating member 300 is operatively coupled with movable members 120A, 120B. In the example embodiment illustrated, second arms 322A, 322C of actuating member 300 engage with movable members 120A, 120B, respectively. Specifically, second arms 322A, 322C include tab portions 332 and 336, respectively, (shown in FIG. 6) carried by end portions of second arms 322A, 322C. Tab portions 332, 336 of second arms 322A, 322C engage with movable members 120A, 120B. Specifically, tab portion 332 of second arm 322A is received by opening 130A of movable member 120A, as shown in FIG. 7. Similarly, tab portion 336 of second arm 322C is received by opening 130B of movable member 120B to engage second arm 322C with movable member 120B. Therefore, actuating member 300, and more particularly second arms 322A, 322C, facilitates mounting of movable members 120A, 120B within image forming apparatus 1000.

Further, as shown in FIG. 5, movable members 120A, 120B may be further supported by a support base 1010, carrying support plates 1008 thereon. Specifically, in the example embodiment illustrated, support base 1010 includes rectangular cutouts 1012A and 1012B which receive support shafts 1016A and 1016B, respectively. Support shafts 1016A, 1016B are received by channels 132A, 132B, respectively, thereby mounting movable members 120A, 120B within image forming apparatus 1000. For example, FIG. 7 illustrates channel 132A of movable member 120A receiving support shaft 1016A and opening 130A of movable member 120A receiving tab portion 332 of second arm 322A thereby mounting movable member 120A within image forming apparatus 1000. Movable member 120B is mounted within image forming apparatus 1000 in a similar manner.

Referring back to FIG. 6, actuating mechanism 200 further includes a biasing member 400. In the example embodiment illustrated, biasing member 400 is a spring coupled with second arm 322B. As shown in FIG. 5, biasing member 400 couples actuating member 300 with support base 1010. Specifically, an end portion of biasing member 400 is coiled around a tab portion 334 of second arm 322B. Another end portion of biasing member 400 is coiled around a support tab 1020 on support base 1010. In this configuration, when a force is applied on first arms 312A, 312B, 312C to move pivotally (clockwise in FIG. 5) about central shaft 302 or towards exit rollers 1002, 1004, second arm 322B may pull biasing member 400 to expand. Further, when the force is removed from first arms 312A, 312B, 312C, biasing member 400 retracts the pivotal movement of first arms 312A, 312B, 312C by pulling second arm 322B towards support tab 1020.

As shown in FIG. 6, actuating mechanism 200 further includes a first lever 410 that is carried by actuating member 300. In the example embodiment illustrated, first lever 410 is carried by an end portion of central shaft 302 so that it extends outside of media sheet path 500, as shown in FIG. 5. First lever 410 may be an integral portion of actuating member 300 or it may be a separate component mounted at the end portion of actuating member 300. First lever 410 follows the pivotal movement of actuating member 300. Specifically, first lever 410 rotates in one of a clockwise or a counter-clockwise direction with the pivotal movement of actuating member 300 about central shaft 302.

Actuating mechanism 200 also includes a torque limiting gear 420, as shown in FIG. 5. Torque limiting gear 420 is carried by a shaft of one of exit rollers 1002, 1004. In the example embodiment illustrated, torque limiting gear 420 is carried by a shaft 1022 of exit roller 1002. Torque limiting gear 420 follows the rotational movement of shaft 1022. Actuating mechanism 200 also includes a second lever 430 mounted on torque limiting gear 420. Second lever 430 follows the rotational movement of torque limiting gear 420, which follows the rotational movement of shaft 1022. Actuating mechanism 200 also includes a stopper 440 in the rotational path of second lever 430 and carried by a portion of image forming apparatus 1000. Stopper 440 limits the rotational movement of second lever 430 when shaft 1022 rotates in a direction to drive exit roller 1002 outward from image forming apparatus 1000 (clockwise in FIG. 5). As a result, second lever 430 limits the rotational movement of shaft 1022. However, torque limiting gear 420 allows shaft 1022 of exit roller 1002 to rotate even when second lever 430 is stopped from rotating by stopper 440.

In operation, stacking implement 20 is used to control the speed of media sheets leaving the interior of image forming apparatus 1000 through exit rollers 1002, 1004 and being deposited in an output bin 1030 (best shown in FIG. 3) formed on the exterior of image forming apparatus 1000. Stacking implement 20 improves a stacking quality of the media sheets leaving exit rollers 1002, 1004 and being collected in output bin 1030.

Referring now to FIGS. 7-10, various operational states of stacking implement 20 are shown. As shown in FIG. 7, a media sheet 1050 is following media sheet path 500 and heading towards exit rollers 1002, 1004. Actuating member 300 is shown obstructing media sheet path 500 ahead of media sheet 1050. Pinching element 100 of stacking implement 20 is shown in the closed state.

Referring now to FIG. 8, actuating member 300 is maneuvered by media sheet 1050. Specifically, a leading edge 1052 of media sheet 1050 contacts actuating member 300 to pivotally move actuating member 300 about central shaft 302. For example, as shown in FIG. 8, leading edge 1052 of media sheet 1050 contacts first arm 312A and pivotally moves actuating member 300 about central shaft 302. Leading edge 1052 of media sheet 1050 moves downstream past first arm 312A and through exit rollers 1002, 1004.

The pivotal movement of actuating member 300 moves pinching element 100 from the closed state to the open state. Specifically, when first arms 312A, 312B, 312C are moved away from media sheet path 500, second arms 322A, 322C of actuating member 300 actuate movable members 120A, 120B. For example, as shown in FIG. 8, second arm 322A actuates movable member 120A to move movable member 120A away from fixed member 110A, thereby allowing pinching element 100 to attain the open state. Specifically, when second arm 322A is pivotally moved, movable member 120A slides about support shaft 1016A and along channel 132A. Similarly, first arm 312C actuates movable member 120B to allow movable member 120B to move away from fixed member 110B, thereby allowing pinching element 100 to attain the open state.

Figure 9:
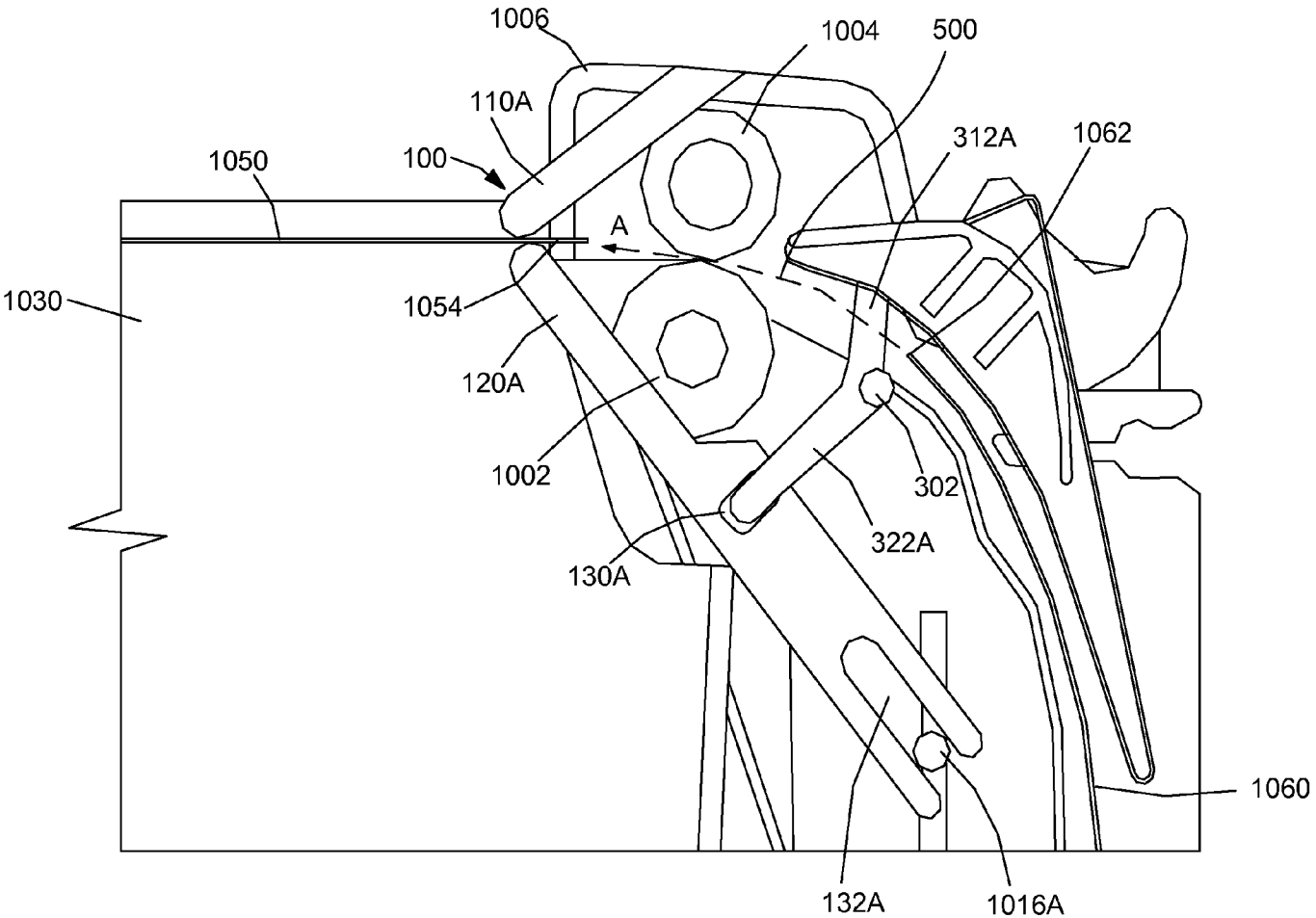

Referring now to FIG. 9, after media sheet 1050 passes, actuating member 300 once again obstructs media sheet path 500 for a subsequent media sheet 1060 and pinching element 100 returns to the closed state and holds a trailing end 1054 of media sheet 1050 before it reaches output bin 1030. Specifically, when trailing end 1054 of media sheet 1050 leaves first arm 312A, biasing member 400 retracts the pivotal movement of actuating member 300 thereby causing pinching element 100 to return to the closed state. For example, when first arm 312A is pivotally moved (counter-clockwise in FIG. 9) by leading edge 1052 of media sheet 1050, second arm 322B moves away from support tab 1020 which causes biasing member 400 (shown in FIG. 5) to expand. When trailing end 1054 of media sheet 1050 leaves first arm 312A, expanded biasing member 400 contracts and causes second arm 322B to move towards support tab 1020 thereby allowing first arm 312A to move pivotally (clockwise in FIG. 9) about central shaft 302 to obstruct media sheet path 500.

When biasing member 400 contracts and causes second arm 322B to move towards support tab 1020, second arm 322A actuates movable member 120A to allow movable member 120A to contact fixed member 110A. Specifically, second arm 322A retracts the movement of movable member 120A about support shaft 1016A and along channel 132A which causes movable member 120A to contact fixed member 110A. It will be appreciated that second arm 322C similarly actuates movable member 120B to contact fixed member 110B and thereby allows pinching element 100 to attain the closed state.

As shown in FIG. 9, trailing end 1054 of media sheet 1050 is held by pinching element 100 in the closed state. Specifically, when leading edge 1052 of media sheet 1050 reaches exit rollers 1002, 1004, exit rollers 1002, 1004 advance media sheet 1050 along media sheet path 500 until trailing end 1054 of media sheet 1050 leaves exit rollers 1002, 1004. When trailing end 1054 of media sheet 1050 leaves actuating member 300, pinching element 100 retracts to the closed state and restricts the movement of media sheet 1050. The rotational movement of exit rollers 1002, 1004 provides a driving force sufficient to enable media sheet 1050 to advance along media sheet path 500 even when pinching element 100 is in the closed state. However, once trailing end 1054 of media sheet 1050 leaves exit rollers 1002, 1004, media sheet 1050 no longer possesses the driving force necessary to overcome the pinching force applied by pinching element 100 and trailing end 1054 is held by pinching element 100. As a result, media sheet 1050 is held by pinching element 100 prior to being received in output bin 1030.

Figure 10:
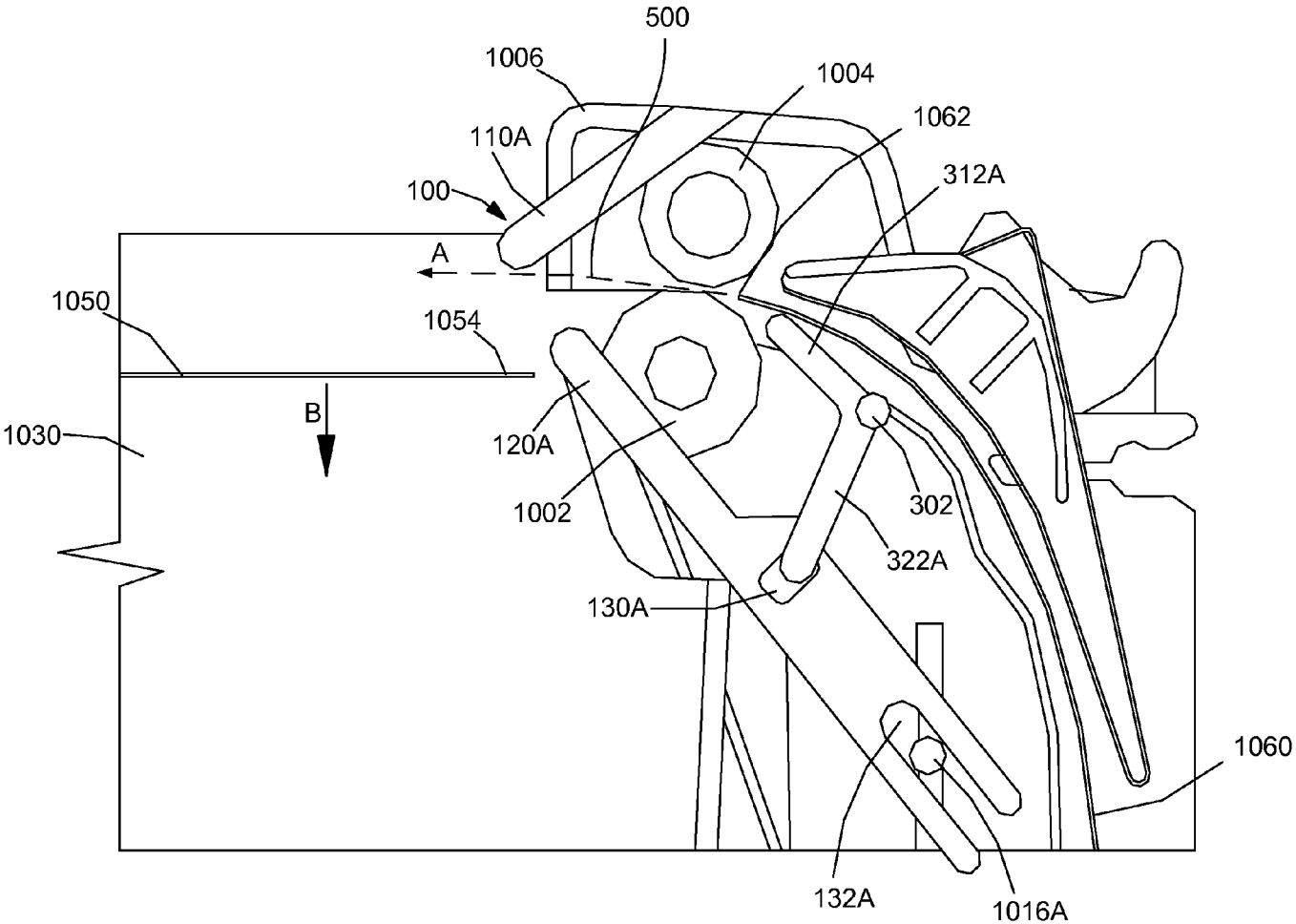

Referring now to FIG. 10, actuating member 300 is maneuvered by subsequent media sheet 1060. Specifically, leading edge 1062 of subsequent media sheet 1060 contacts actuating member 300 to pivotally move actuating member 300 away from media sheet path 500. For example, as shown in FIG. 10, leading edge 1062 of subsequent media sheet 1060 contacts first arm 312A to pivotally move first arm 312A about central shaft 302 and away from media sheet path 500. The pivotal moment of first arm 312A allows pinching element 100 to once again move to the open state thereby releasing trailing end 1054 of media sheet 1050 from pinching element 100 and allowing media sheet 1050 to be received by output bin 1030. When media sheet 1050 is released by pinching element 100, media sheet 1050 drops via gravity along a direction shown by arrow B to reach output bin 1030. Media sheets following media sheet 1050, such as subsequent media sheet 1060, are held and released by pinching element 100 prior to collection in output bin 1030 in a similar manner. This allows stacking implement 20 to control the speed of the media sheets, such as media sheets 1050 and 1060, leaving image forming apparatus 1000. This allows the media sheets to be uniformly and properly collected in output bin 1030 thereby achieving a desired stacking quality even at increased output speeds.

It will be appreciated that a media sheet, such as media sheet 1050, will be collected in output bin 1030 when a subsequent media sheet, such as subsequent media sheet 1060, actuates actuating mechanism 200 of stacking implement 20. However, in the case of either a lone media sheet or a last media sheet of multiple media sheets, pinching element 100 of stacking implement 20 will retain the trailing end of the media sheet. Therefore, in some embodiments, a user must manually pull the lone media sheet or last media sheet held by pinching element 100 from image forming apparatus 1000.

Alternatively, exit rollers 1002, 1004 may be configured to release the lone or last media from pinching element 100 by rotating in a direction opposite media process direction A. It will be appreciated that exit rollers 1002, 1004 may be rotated opposite media process direction A by a bi-directional motor (not shown) that drives exit rollers 1002, 1004 in media process direction A. Alternatively, exit rollers 1002, 1004 may be driven opposite media process direction A by a second motor (not shown), that rotates the pair of exit rollers 1002, 1004 opposite the media process direction when either of the lone media sheet or the last media sheet is held by pinching element 100.

Figure 11:
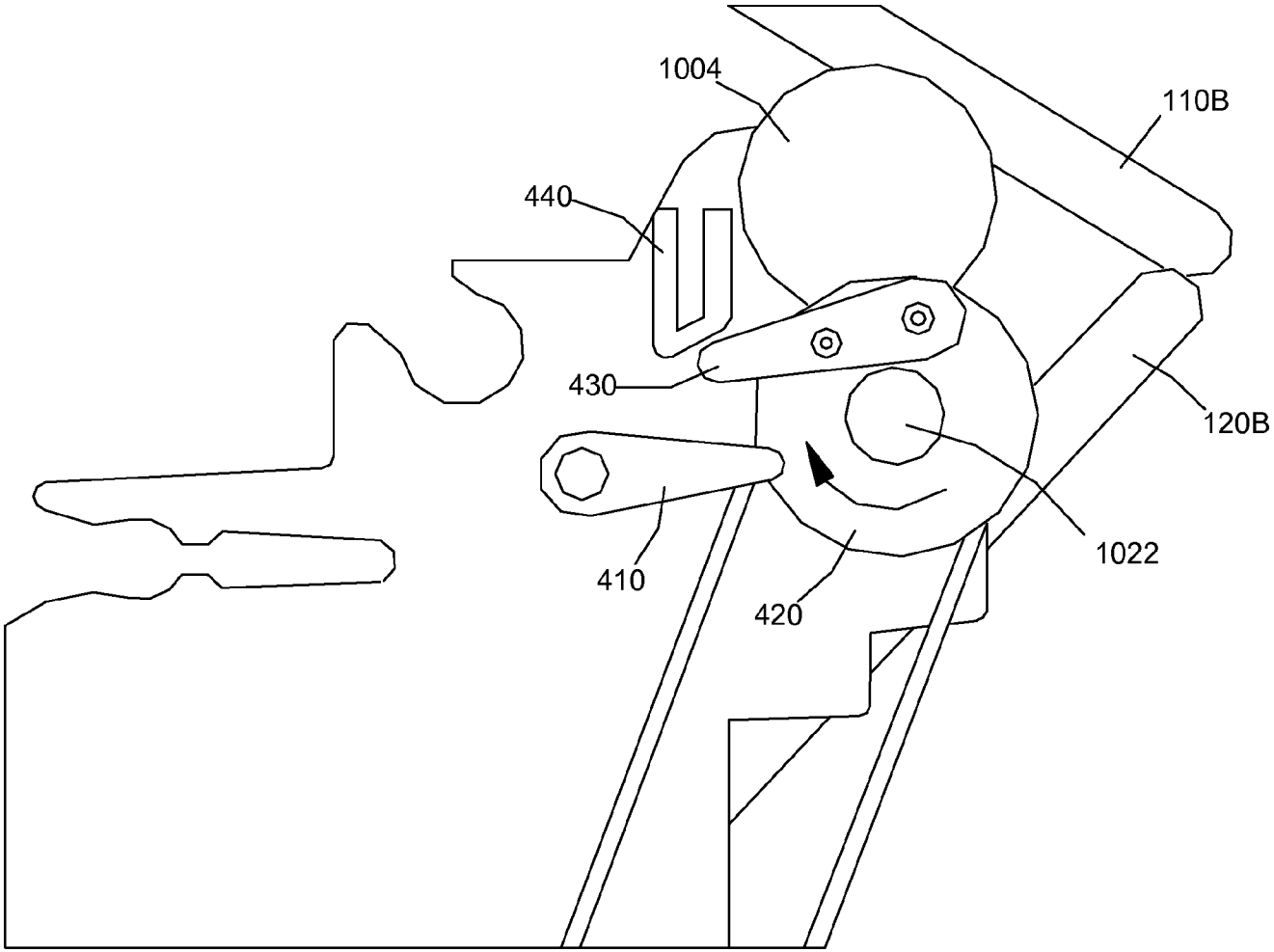
FIGS. 11 and 12 are side views depicting operational states of the media sheet stacking implement in conjunction with either a lone media sheet or a last media sheet of multiple media sheets according to one example embodiment.
Figure 12:
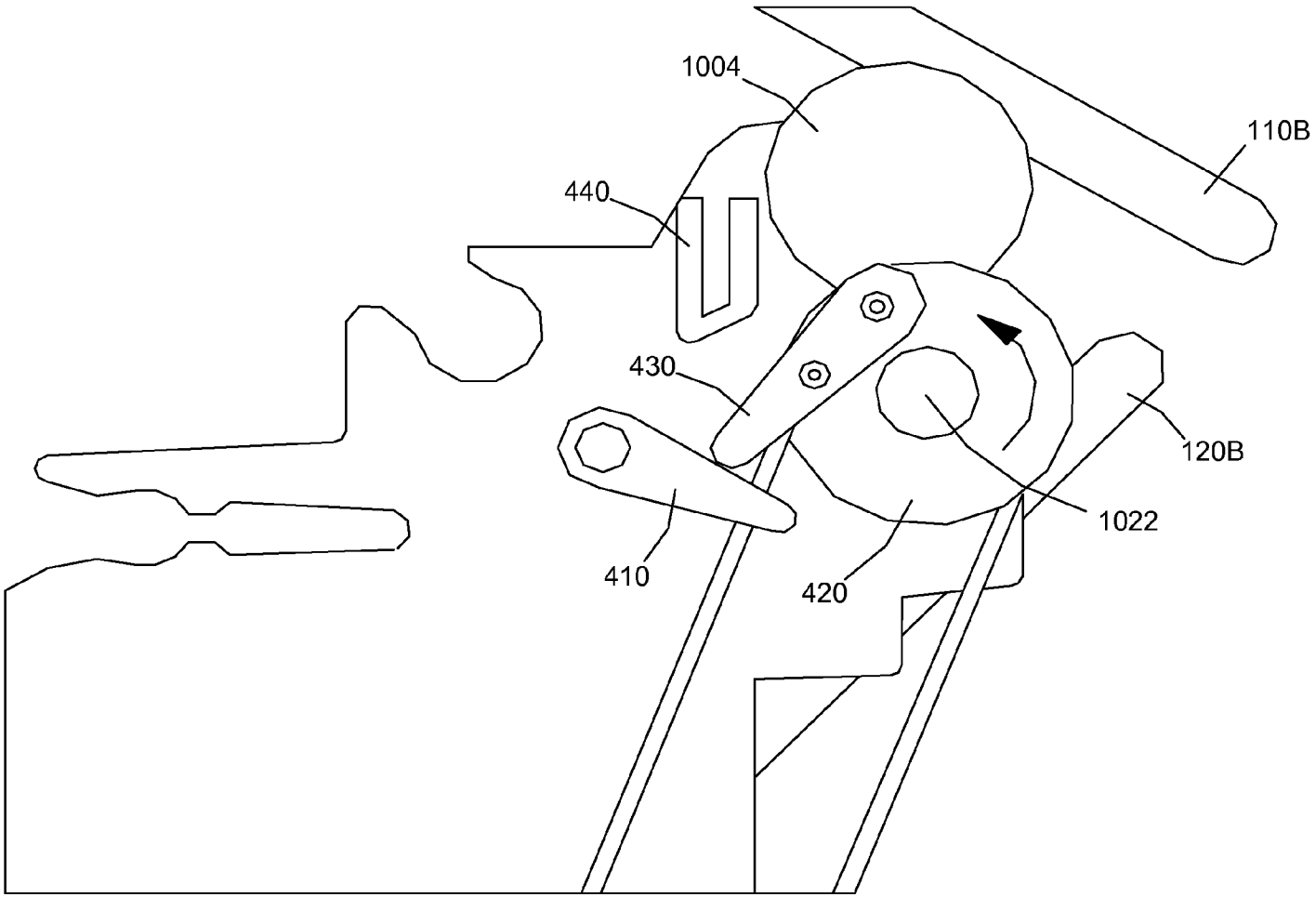

In the example embodiment illustrated in FIGS. 11 and 12, when exit rollers 1002, 1004 rotate opposite media process direction A, pinching element 100 expands from the closed state to the open state and thereby releases the trailing end of either the lone media sheet or the last media sheet held therein. For example, as shown in FIG. 11, pinching element 100 is in the closed state wherein movable member 120B of pinching element 100 is in contact with fixed member 110B. Referring now to FIG. 12, when exit rollers 1002, 1004 rotate opposite the media process direction, second lever 430 actuates first lever 410, thereby expanding pinching element 100 to the open state. Specifically, as mentioned above, torque limiting gear 420 is mounted on shaft 1022 of exit roller 1002 and second lever 430 is mounted on torque limiting gear 420. When exit rollers 1002, 1004 rotate opposite the media process direction (counter-clockwise in FIG. 12), torque limiting gear 420 rotates along with exit roller 1002 causing second lever 430 to rotate along with torque limiting gear 420. As a result, torque limiting gear 420 actuates first lever 410 which in turn pivotally moves actuating member 300 about central shaft 302 to expand pinching element 100 from the closed state to the open state, in a similar manner as explained in conjunction with FIGS. 7-10.

In order to move pinching element 100 to the open state to release the trailing end of a media sheet held therein, exit rollers 1002, 1004 typically only need to rotate opposite the media process direction for a relatively short period of time. For example, the time period of rotation opposite the media process direction must be sufficient to allow movable members 120A, 120B to separate from fixed members 110A, 110B, respectively, enough to release the trailing end of the lone media sheet or the last media sheet so that such media sheet may be received in output bin 1030.

With reference to FIG. 3, in some embodiments, output bin 1030 includes a curved, concave rear wall 1032 that extends downward to output bin 1030 beneath pinching element 100. Rear wall 1032 enhances the stacking quality of the media sheets therein. The curvature of rear wall 1032 accommodates the arching motion of the trailing edge of the media sheet as it descends into output bin 1030. Alternatives include those wherein rear wall 1032 is angled such that as each media sheet enters output bin 1030, the trailing edge contacts rear wall 1032 which aids in guiding the media sheet to the rear of output bin 1030 proximate to exit rollers 1002, 1004. Such modification of output bin 1030 in conjunction with stacking implement 20 may further enhance the stacking quality of the media sheets collected in output bin 1030.

The present disclosure provides a media sheet stacking implement, such as media sheet stacking implement 20, for use with an image forming apparatus, such as a printer or a copier. The media sheet stacking implement controls the speed of media sheets leaving a pair of exit rollers and entering an output bin of the image forming apparatus. This improves the stacking quality of the media sheets collected in the output bin.

The foregoing description of several embodiments of the present disclosure has been presented for purposes of illustration. It is not intended to be exhaustive or to limit the present disclosure to the precise forms disclosed, and obviously many modifications and variations are possible in light of the above teaching. It is intended that the scope of the present disclosure be defined by the claims appended hereto.

What is claimed is:

1. A media sheet stacking implement for an image forming apparatus, comprising:

an exit nip formed by a first exit roller and a second exit roller for advancing media in a media process direction along a media path and delivering the media to an output bin of the image forming apparatus;

a pinching element mounted along the media path downstream from the exit nip and having at least one first member and at least one second member movable relative to the at least one first member between a closed state and an open state; and an actuating mechanism operatively coupled with the pinching element for moving the pinching element between the closed state and the open state to allow the pinching element to hold a trailing end of a media sheet and reduce the speed of the media sheet being delivered to the output bin when in the closed state and to allow the pinching element to release the held trailing end of media sheet to complete delivery of the media sheet to the output bin when in the open state.

2. The media sheet stacking implement of claim 1, wherein the position of the at least one first member of the pinching element is fixed.

3. The media sheet stacking implement of claim 1, wherein the actuating mechanism includes an actuating member pivotally mounted along the media path and operatively coupled with the at least one second member of the pinching element.

4. The media sheet stacking implement of claim 3, wherein the actuating member includes a central shaft pivotally mounted on the image forming apparatus and at least one first arm extending from the central shaft at a first angle and biased by a biasing member toward a home position obstructing the media path upstream from the exit nip.

5. The media sheet stacking implement of claim 4, wherein when a leading edge of a media sheet traveling in the media process direction along the media path contacts the at least one first arm, the actuating member pivotally moves and causes the at least one second member to move away from the at least one first member thereby causing the pinching element to move from the closed state to the open state and when the trailing edge of the media sheet leaves the actuating member, the biasing member returns the at least one first arm to the home position thereby moving the at least one second member toward the at least one first member causing the pinching element to move from the open state to the closed state to hold the trailing end of the media sheet.

6. The media sheet stacking implement of claim 4, wherein the actuating member includes at least one second arm extending from the central shaft at a second angle different from the first angle and engaged with the at least one second member of the pinching element.

7. The media sheet stacking implement of claim 6, further comprising:

an opening in a central portion of the at least one second member of the pinching element; and a tab portion on the at least one second arm of the actuating member that is received by the opening for engaging the at least one second arm with the at least one second member.

8. The media sheet stacking implement of claim 4, further comprising:

a first lever mounted on the central shaft of the actuating member that rotates therewith;

a torque limiting gear on a shaft of one of the first exit roller and the second exit roller that rotates therewith; and a second lever mounted on the torque limiting gear that rotates therewith;

wherein rotation of the exit nip in a direction opposite the media process direction causes the second lever to contact and actuate the first lever thereby rotating the central shaft of the actuating member and causing the at least one second member to move away from the at least one first member to move the pinching element from the closed state to the open state.

9. The media sheet stacking implement of claim 8, further comprising a stopper on a housing of the image forming apparatus in the rotational path of the second lever for limiting the amount of rotation of the second lever when the exit nip rotates in the media process direction.

10. The media sheet stacking implement of claim 1, further comprising:

a channel in an end portion of the at least one second member of the pinching element; and a support base of the image forming apparatus having at least one support shaft that is received by the channel for mounting the at least one second member to the image forming apparatus.

11. The media sheet stacking implement of claim 1, wherein the at least one first member of the pinching element is mounted to a top cover cap of the image forming apparatus.

12. The media sheet stacking implement of claim 1, wherein the at least one first member and the at least one second member of the pinching element are elongated, flat members having rounded tips.

13. A media sheet stacking implement for an image forming apparatus, comprising:

an exit nip formed by a first exit roller and a second exit roller for advancing media in a media process direction along a media path and delivering the media to an output bin of the image forming apparatus;

a pinching element mounted along the media path downstream from the exit nip and having at least one fixed member and at least one movable member movable between a closed state wherein the at least one fixed member and the at least one movable member are in contact with each other and an open state wherein the at least one fixed member and the at least one movable member are spaced apart from one another; and an actuating member pivotally mounted along the media path and operatively coupled with the at least one movable member of the pinching element for moving the pinching element between the closed state and the open state to allow the pinching element to hold a trailing end of a media sheet to reduce the speed of the media sheet being delivered to the output bin when in the closed state and to allow the pinching element to release the held trailing end of the media sheet to complete delivery of the media sheet to the output bin when in the open state.

14. The media sheet stacking implement of claim 13, wherein the actuating member includes a central shaft pivotally mounted on the image forming apparatus and at least one first arm extending from the central shaft at a first angle and biased by a biasing member toward a home position obstructing the media path upstream from the exit nip.

15. The media sheet stacking implement of claim 14, wherein the actuating member includes at least one second arm extending from the central shaft at a second angle different from the first angle and engaged with the at least one movable member of the pinching element.

16. The media sheet stacking implement of claim 14, further comprising:

a first lever mounted on the central shaft of the actuating member that rotates therewith;

a torque limiting gear on a shaft of one of the first exit roller and the second exit roller that rotates therewith; and a second lever mounted on the torque limiting gear that rotates therewith;

wherein rotation of the exit nip in a direction opposite the media process direction causes the second lever to contact and actuate the first lever thereby rotating the central shaft of the actuating member and causing the at least one movable member to move away from the at least one fixed member to move the pinching element from the closed state to the open state.

17. A method for controlling the speed of a media sheet exiting an image forming apparatus, comprising:

advancing the media sheet along a media path in a media process direction through an exit nip formed by a pair of exit rollers;

advancing the media sheet between a pair of opposed members of a pinching element in an open state downstream from the exit nip;

moving the pinching element from the open state to a closed state to hold a trailing end of the media sheet and reduce the speed of the media sheet; and moving the pinching element from the closed state to the open state to release the trailing end of the media sheet to allow the media sheet to be collected in an output bin of the image forming apparatus.

18. The method of claim 17, wherein the pinching element moves from the open state to the closed state when the trailing edge of the media sheet passes an actuating member positioned along the media path upstream from the exit nip.

19. The method of claim 17, wherein the pinching element moves from the closed state to the open state when a leading edge of a subsequent media sheet contacts an actuating member positioned along the media path upstream from the exit nip.

20. The method of claim 17, wherein the pinching element is moved from the closed state to the open state by rotating the exit rollers opposite the media process direction.

21. The media sheet stacking implement of claim 1 wherein the actuating mechanism when in the closed state momentarily stop the media sheet being delivered to the output bin and the actuating mechanism when in the open state allowed the held end of the momentarily stopped media sheet to drop into the output bin.

22. The media sheet stacking implement of claim 13 wherein the actuating mechanism when in the closed state momentarily stops the media sheet being delivered to the output bin and the actuating mechanism when in the open state allows the held end of the momentarily stopped media sheet to drop into the output bin.

* * * * *